United States Patent [19]

Hashizume

[11] Patent Number: 4,858,587

[45] Date of Patent: Aug. 22, 1989

[54] IGNITION DEVICE FOR AN INTERNAL COMBUSTION ENGINE

[75] Inventor: Atsushi Hashizume, Himeji, Japan

[73] Assignee: Mitsubishi Denki Kabushiki Kaisha, Tokyo, Japan

[21] Appl. No.: 197,317

[22] Filed: May 23, 1988

[30] Foreign Application Priority Data

May 27, 1987 [JP] Japan ..... 62-82678[U]

[51] Int. Cl.[4] ..... F02P 11/00

[52] U.S. Cl. ..... 123/631; 123/652

[58] Field of Search ..... 123/179 BG, 603, 631, 123/651, 652, 149 C

[56] References Cited

U.S. PATENT DOCUMENTS

| | | | |
|---|---|---|---|
| 3,795,235 | 3/1974 | Donohue et al. | 123/631 X |
| 4,401,096 | 8/1983 | Podrapsky | 123/631 |
| 4,491,122 | 1/1985 | Piteo | 123/631 |
| 4,651,705 | 3/1987 | Kinoshita | 123/603 |

FOREIGN PATENT DOCUMENTS 75075 4/1987 Japan .

*Primary Examiner*—Tony M. Argenbright

*Attorney, Agent, or Firm*—Oblon, Spivak, McClelland, Maier & Neustadt

[57] ABSTRACT

An ignition device for an internal combustion engine comprises a sensor for producing a first and a second angular angle corresponding to a first and a second crank position, respectively, a flip-flop circuit which is set or reset by the first angular signal of the sensor and is reset or set by the second angular signal, ignition control unit for controlling the primary current of an ignition coil based on the output of the flip-flop circuit and carrying out the ignition operation based on the second angular signal, unit for producing a voltage when the internal combustion engine reverses, and unit for comparing the voltage produced by the voltage producing unit with a predetermined voltage, and causing the second angular signal to be ignored depending on the results of comparison so as to prevent the flip-flop circuit from being reset or set.

3 Claims, 4 Drawing Sheets

IGNITION DEVICE FOR AN INTERNAL COMBUSTION ENGINE

BACKGROUND OF THE INVENTION

1. FIELD OF THE INVENTION

The present invention relates to an ignition device for an internal combustion engine which is capable of preventing ignition spark from occuring when the engine rotates in the direction opposite to a predetermined direction.

2. 2. DISCUSSION OF BACKGROUND

One device of this type as is known in the art is shown in FIG. 3. In FIG. 3, a reference numeral 1 designates a rotor which is driven by the engine (not shown) in the direction of an arrow 2. The rotor has a predetermined size of projection formed on the circumferential surface between positions A and B.

A pickup 3 is arranged to be opposite to the rotor 1 so as to work as an angular position sensor. The pickup 3 detects a first crank angle and a second crank angle. When the forward end A of the projection located on the side of the rotational direction passes over the pickup 3, the pickup outputs a positive voltage indicative of the first angular signal. On the other hand, when the rearward end B of the projection located on the side of the anti-rotational direction passes the pickup 3, the pickup outputs a negative voltage indicative of the second angular signal.

The pickup 3 has a coil connected to a first diode 4 and a second diode 5 so that the first and the second diode perform a distinction between the positive and the negative voltage.

The first diode 4 has the anode connected to the coil of the pickup 3 and the cathode connected to the set input terminal of a flip-flop (hereinbelow, referred to as FF) 6.

The second diode 5 has the cathode connected to the coil of the pickup 3 and the anode connected to the reset input terminal of the FF 6.

As a result, positive waves in the output voltage of the pickup 3 pass through the first diode 4 and come into the set input terminal of the FF 6 so as to cause the flip-flop to set to the 1 state. On the other hand, negative waves in the output voltages of the pickup 3 pass through the second diode 5 and come into the reset input terminal of the FF 6 so as to cause the FF 6 to reset to the 0 state.

A transistor 7 with the emitter grounded has the base connected to the output terminal Q of the FF 6 and the collector connected to one end of the primary winding of an ignition coil 8.

The other end of the primary winding of the ignition coil 8 is connected to a battery 8 through a key switch 9. The high-tension cable of the ignition coil 8 is connected to an ignition plug 11.

FIG. 5 is a drawing of waveforms to help explain the operation of the system as shown in FIG. 3. The output voltage a of the pickup 3 is shown in FIG. 5 at (A). The set input voltage b of the FF 6 is shown in FIG. 5 at (B). The reset input voltage c of the FF 6 is shown in FIG. 5 at (C). The output voltage d at the output terminal Q of the FF 6 is shown in FIG. 5 at (D). The primary current e of the ignition coil 8 is shown in FIG. 5 at (E). The secondary voltage f of the ignition coil 8 is shown in FIG. 5 at (F). That is to say, the waveforms at the positions a–f in FIG. 3 are shown in FIG. 5 at (A)—(F).

In operation, when the rotation of the rotor 1 causes the forward end A of the projection to become opposite to the pickup 3, the positive voltage is induced in the pickup coil based on the principal of electromagnetic induction. The induced positive voltage causes the FF 6 to set to the 1 state through the first diode 4. As a result, the output terminal Q of the FF 6 becomes a high level (hereinbelow, referred to as "1").

The "1" signal from the output terminal Q allows the transistor 7 to conduct so that the primary current of the ignition coil 8 starts flowing at the moment.

When the rotation of the rotor 1 progresses, the rearward end B of the projection becomes opposite to the pickup 3. At this time, the negative voltage is induced in that pickup coil. The induced negative voltage causes the FF 6 to reset through the second diode 5. As a result, the output terminal Q of the FF 6 becomes are a low level (hereinbelow, referred to as "0". The "0" signal from the output terminal Q cut off the transistor 7 to interrupt the primary current of the ignition coil 8. At the interrupting moment, a high voltage is induced in the secondary winding of the ignition coil 8 to produce an ignition spark at the ignition plug 11. Ignition sparks subsequent to the ignition spark as just mentioned are cyclically produced in accordance with the progressing rotation of the rotor 1 as shown in FIG. 5.

Although there is no inconvenience in the normal operation, there is inconvenience in the normal operation, such as the presence of a wide range of fluctuation in the rotation of the engine at the time of starting the engine, and the occurence of the reverse rotation of the engine caused by failing to overcome counter-torque, as follows.

For example, imagine that the system is constructed so that the forward end A of the rotor 1 detects BTDC (before top dead center) 35 degrees and the rearward end B detects BTDC 5 degrees (for example, the BTDC 5 degrees correspond to the initial ignition timing, the BTDC 35 degrees correspond to the operation commencement time in an electric advance type of ignition timing operation circuit. Both figure are quite usual.).

Assuming that the rotor 1 was in the position as shown in FIG. 3 before starting the engine and the starting operation starts. The rotor 1 starts to be gradually rotated by external force such as a starter (not shown) in the direction indicated by the arrow 2 (hereinbelow, referred to as 'the forward direction') or 'forward rotation'). When the forward end A becomes opposite to the pickup 3, the positive voltage is induced in the pickup coil to cause the FF 6 to set to the 1 state. As a result, the primary current starts through the ignition coil 8.

After that, when the rotor continues the forward rotation, the engine approaches the top center in its compression stroke to receive the counter-torque being increased. Under bad conditions wherein the battery is almost discharged or the outside temperature is low, the engine sometimes fails to rotate beyond the top dead center in the compresson stroke and is reversed on the way.

In addition, there is a possibility of stopping the starting operation (turning off the starter switch) before the engine has fired. In such case, the driving force given to the engine goes down to 0, accelerating the reverse rotation by the counter-torque.

In either case, the rotor 1 which has progressed the forward rotation up to around, for example, the BTDC 15 degrees, starts the reverse rotation from that point.

In the course of the reverse rotation of the rotor, the change in the magnetic field caused when the forward end A passes over the pickup 3 is the same as that caused when the rearward end B becomes opposite to the pickup 3 in the course of the forward rotation of the rotor. As a result, when the forward end A passes over the pickup 3 in the course of the reverse rotation, the negative voltage is induced in the pickup coil.

For the reasons, the induced negative voltage causes the FF 6 to reset to interrupt the primary current in the ignition coil 8 so that the ignition spark is produced at that moment.

In other wards, the ignition spark is produced at the position of BTDC 35 degrees in terms of engine crank angle. That causes the compressed and mixed air and gasoline vapor to be ignited so as to add further reverse rotation torque to the engine being reversed. As a result, the reverse rotation of the engine is acceleratated, and the engine is sometimes destroyed.

Since the conventional ignition device for an internal combustion engine is constructed as mentioned above, there is a disadvantage in that the ignition spark can be produced even in the reverse rotation of the engine to destroy the engine.

SUMMARY OF THE INVENTION

It is an object of the present invention to eliminate the disadvantage of the conventional ignition device and to provide a new and improve ignition device for an internal combustion engine capable of avoiding the igntion at the time of the reverse rotation of the engine.

The foregoing and the other objects of the present invention have been attained by providing an ignition device for an internal combustion engine comprising means for producing a voltage when the internal combustion engine reverses, a flip-flop circuit which is set and reset by the outputs of a pickup, and means for comparing the output voltage of the voltage producing means with a predetermined reference voltage to ignore a second angular signal according to the results of the comparison.

In accordance with the present invention, the voltage producing means produces the voltage when the internal combustion engine reverses. The voltage causes the result of the comparison to be reversed to ignore the second angular signal so as to prevent the flip-flop circuit from being reset or set.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, the present invention will be described in detail with reference to a preferred embodiment illustrated in the accompanying drawings.

Figure 1:
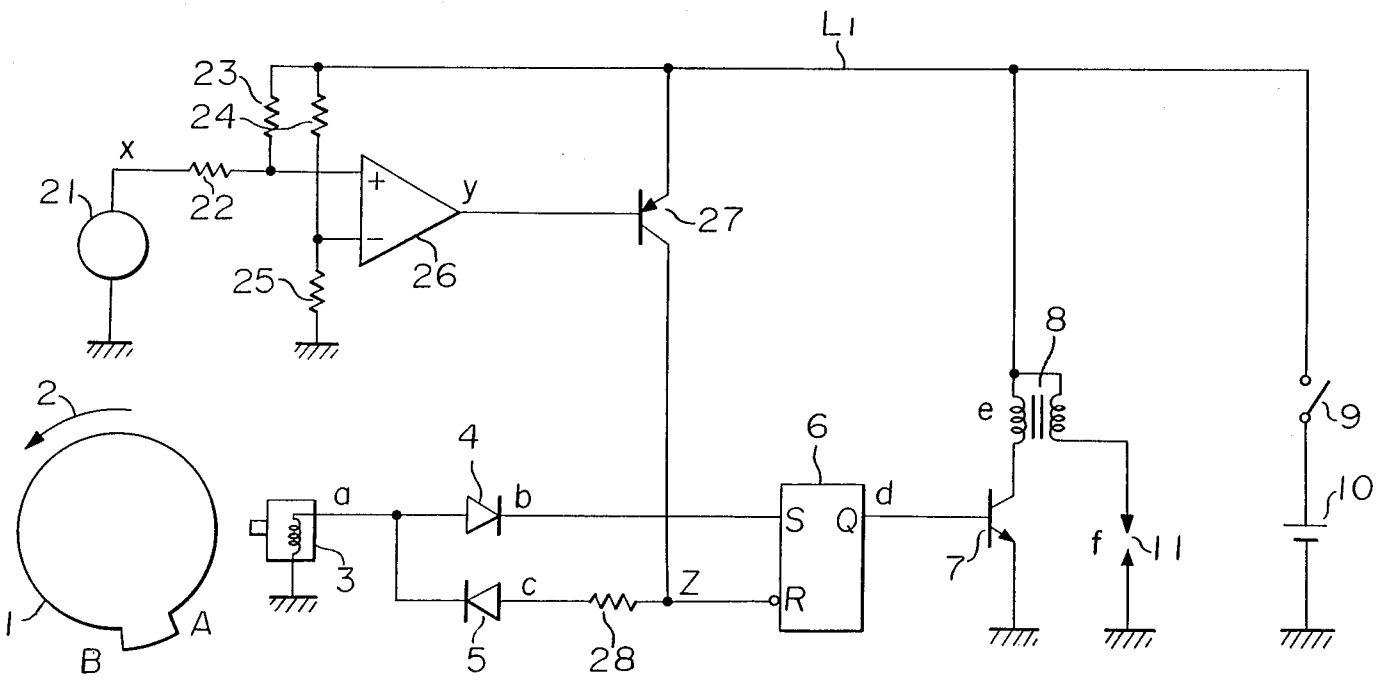
FIG. 1 is a circuit diagram showing an embodiment of the ignition device according to the present invention.
Figure 3:
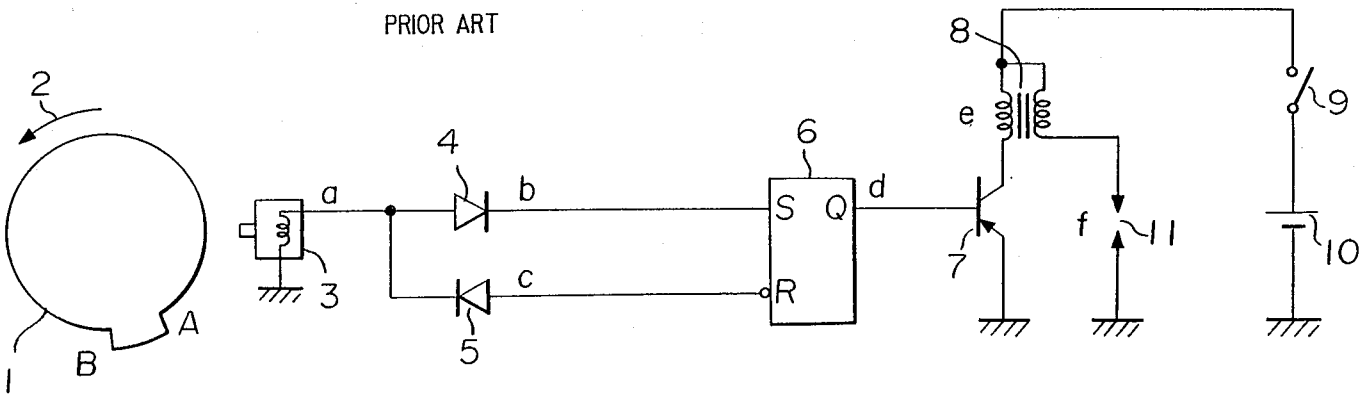
FIGURE 3 PRIOR ART
FIG. 3 is a circuit diagram showing the conventional ignition device.
Figure 4:
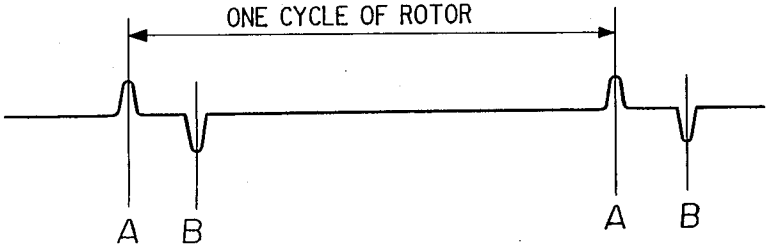
FIGURE 4 PRIOR ART
FIGS. 4, 5(A–F) and 6(A–C) are drawings of waveforms to help explain the operation of the conventional ignition device as shown in FIG. 3.
Figure 5:
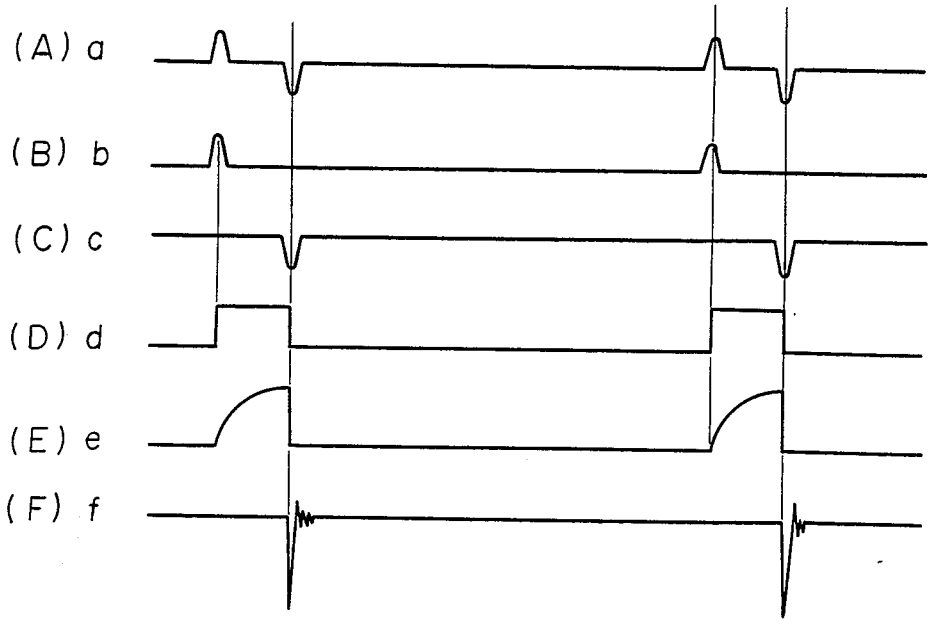
FIGURE 5 PRIOR ART
Figure 6:
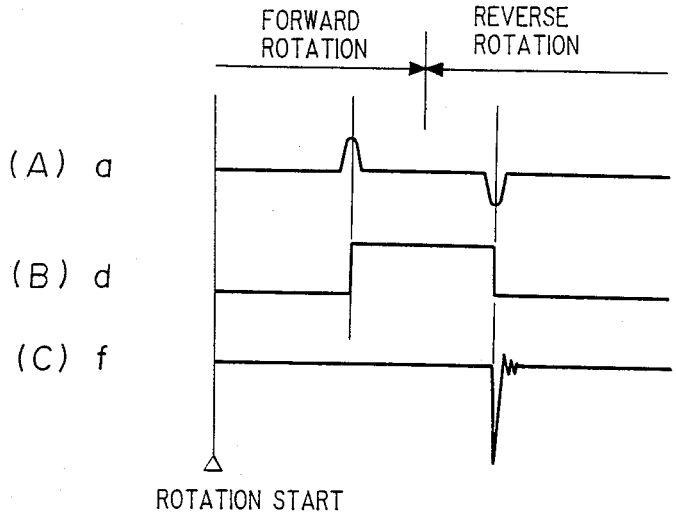
FIGURE 6 PRIOR ART

FIG. 1 is a circuit diagram showing the structure of the embodiment. In FIG. 1, components having the same functions as the components in FIG. 3 are designated with the same reference numerals and explanation on these components is omitted for the sake of clarity. Now, the features of the ignition device according to the present invention, which are different from the conventional ignition device as shown in FIG. 3, will be mainly described.

The ignition device according to the present invention as shown in FIG. 1 is common to the conventional ignition device as shown in FIG. 3 in that components indicated by reference numerals 1 through 11 in Figure 1 have the same functions as those indicated by the reference numerals 1 through 11 in FIG. 3, and is different from the latter in that components indicated by reference numerals 21 through 27 are added to the structure of the conventional ignition device as shown in FIG. 3. In FIG. 1, the reference numeral 21 designates a starter for starting the engine. The output voltage of the starter 21 gives a suitable bias voltage to resistors 22, 23. Wiring for the starter 21 is not shown in FIG. 1.

In the embodiment, the phenomenon that when the rotor of the starter 21 is reversely rotated by the reverse rotation of the engine, a negative voltage from the starter 21 is produced is utilized. The output voltage of the starter is input into a positive input terminal of a comparator 26 by means of the resistors 22, 23.

The negative input terminal of the comparator 26 is grounded through a resistor 25. The positive input terminal of the comparator is connected to the positive terminal of a battery 10 through the resistor 23 and the key switch 9. The lead connected between the resistor 23 and the key switch 9 is hereinbelow called a line $L_1$.

A resistor 24 as well as the resistor 25 is inserted the line $L_1$ and the ground so as to give a predetermined voltage to the negative input terminal of the comparator 26. The comparator 26 has the output terminal connected to the base of a transistor 27.

The transistor 27 has the emitter connected to the line $L_1$ and the collector connected to the reset input terminal R of the FF 6.

The transistor 27 is conducted or cut off depending on the state of the output of the comparator 26.

Between the anode of the diode 5 and the junction of the collector of the transistor 27 and the reset input terminal R of the RR 6 is inserted a resistor 28 for restricting current. The other structure is similar to the structure as shown in FIG. 3.

Figure 2:
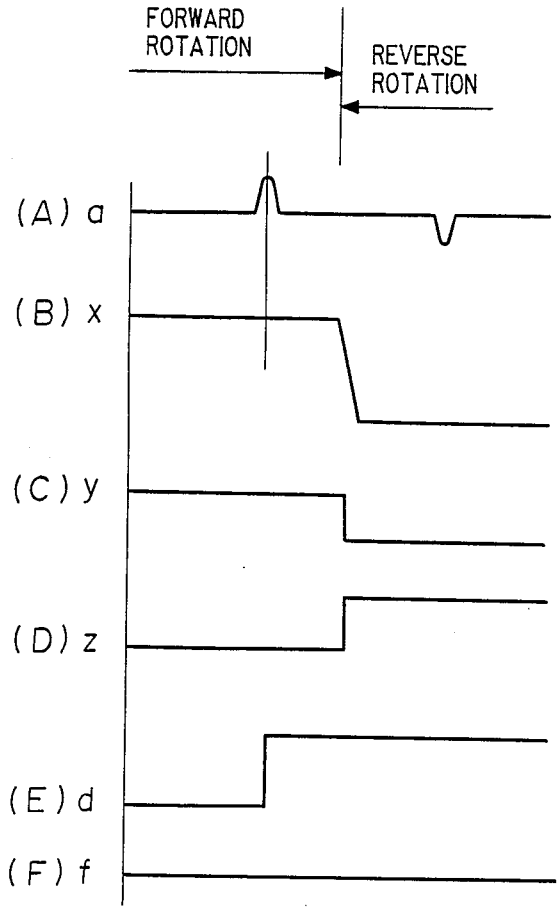
FIGS. 2(A–F) are a drawing of waveforms to help explain the operation of the circuit of FIG. 1.

Now, the operation of the ignition device according to the present invention will be explained referring to the waveforms as shown in FIG. 2. The output signal a of the pickup 3 is shown in FIG. 2 at (A), the output x of the starter 21 is shown in FIG. 2 at (B), the output y of the comparator 26 is shown in FIG. 2 at (C), a signal z at the reset input terminal R of the FF 6 is shown in FIG. 2 at (D), the output d of the FF 6 is shown in FIG. 2 at (E), and an ignition signal f is shown in FIG. 2 at (F).

FIG. 2 shows a case that the engine starts to rotate in the forward direction and then it reverses. When the rearward end A of the projection of the rotor 1 comes to a position opposite to the pickup 3, a positive voltage is induced in the pickup 3 based on the principle of electromagnetic induction, to cause the FF 6 to be set to the 1 state. Thus, the primary current starts to flow in the ignition coil 8.

If the engine starts to reverse before the projection of the rotor 1 has passed over the pickup 3 in the forward direction, a negative voltage as shown in FIG. 2 at (B) appears at the terminal of the starter 21 before a negative waveform is induced in the pickup 3. The negative output voltage caused at the terminal of the starter is voltage-divided by the bias resistors 22, 23 to become an appropriate voltage so as to cause the positive input terminal of the comparator 26 to come down to the low level. As a result, the output voltage y of the comparator 26 lowers to the low level as shown in FIG. 2 at (C) to make the transistor 27 conduct, and the reset input terminal R of the FF 6 rises to the high level. Under the circumstances, the negative wave which is induced in the pickup 3 when the forward end A of the rotor 1 passes the pickup 3 during the reverse rotation of the rotor, can not cause the FF 6 to reset.

For this reason, the transistor 7 is not cut off because the output of the FF 6 is not inverted by the negative wave induced in the pickup 3. Thus, the primary current of the ignition coil 8 is prevented from being interrupted, and a high voltage is not induced in the secondary side to avoid ignition.

When the engine does not reverse, the negative voltage does not appear at the terminal of the starter. The output terminal of the comparator 26 maintains held the high level and the transistor 27 maintains off. As a result, the ignition device according to the present invention does not adversely affect the ignition operation in the normal conditions like the conventional ignition device.

Although in the embodiment the starter 21 is utilized as the means for producing a voltage when the engine reverses, other generator or component producing a voltage when the engine reverses may be used in place of the starter.

Although the comparator 26 is used to carry out the voltage comparison in the embodiment, the voltage between the base and the emitter of a transistor may be used as a threshold to perform a similar function.

The present invention is not limited to the current interrupting type ignition system like the embodiment. It is also applicable to a CDI (condensor discharge ignition) type ignition system.

As explained, in accordance with the present invention, the voltage that is caused when the engine reverses is compared to the predetermined voltage so that the second angular signal is ignored based on the results of the comparison so as to prevent the flip-flop circuit from being reset or set. As a result, even if the internal combustion engine reverses, the ignition spark is not produced to eliminate the ignition. That offers a safe device capable of preventing the engine from being destroyed.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition device for an internal combustion engine comprising:

a sensor for producing a first and a second angular signal corresponding to a first and a second crank angle, respectively, a flip-flop circuit which is set or reset by the first angular signal of the sensor and is reset or set by the second angular signal, ignition control means for controlling the primary current of an ignition coil based on the output of the flip-flop circuit and carrying out the ignition operation based on the second angular signal, means for producing a voltage when the internal combustion engine reverses, and means for comparing the voltage produced by the voltage producing means with a predetermined voltage, and causing the second angular signal to be ignored depending on the results of comparison so as to prevent the flip-flop circuit from being reset or set.

2. An internal combustion engine according to claim 1, wherein the voltage producing means comprises a starter.

3. An ignition device according to claim 1, wherein a comparator is used to carry out the voltage comparison.

* * * * *